US006035164A

United States Patent [19]

Baek

[11] Patent Number: 6,035,164

[45] Date of Patent: Mar. 7, 2000

[54] REFILL CARTRIDGE FOR WET ELECTROPHOTOGRAPHIC PRINTER

[75] Inventor: Chung-kuk Baek, Suwon, Rep. of Korea

[73] Assignee: Samsung Electronics Co., Ltd., Kyungki-Do, Rep. of Korea

[21] Appl. No.: 09/100,085

[22] Filed: Jun. 19, 1998

[30] Foreign Application Priority Data

Feb. 27, 1998 [KR] Rep. of Korea ..... 98-6482

[51] Int. Cl.[7] ..... G03G 15/10

[52] U.S. Cl. ..... 399/238

[58] Field of Search ..... 399/98, 102, 103, 399/106, 119, 223, 224, 233, 237, 238, 258, 262

[56] References Cited

U.S. PATENT DOCUMENTS 5,208,637 5/1993 Landa ..... 222/DIG. 1 X
5,248,847 9/1993 Aoyama ..... 399/238
5,396,316 3/1995 Smith ..... 399/238 X
5,500,719 3/1996 Ichikawa et al. ..... 399/238
5,576,816 11/1996 Staudt et al. ..... 399/262
5,655,194 8/1997 Landa et al. ..... 399/238

*Primary Examiner*—Sandra Brase
*Attorney, Agent, or Firm*—Sughrue, Mion, Zinn, Macpeak & Seas, PLLC

[57] ABSTRACT

A refill cartridge for a wet electrophotographic printer. The refill cartridge, for supplying ink to an ink cartridge fixed in a printer main body having a hollow area therein, includes: a case having an air hole and an ink supply hole, for detachable installation in the hollow area; a disk slidably mounted within the case; a spring for elastically biasing the disk toward the ink supply hole; and an ink supply hole plug capable of opening and closing the ink supply hole.

11 Claims, 8 Drawing Sheets

REFILL CARTRIDGE FOR WET ELECTROPHOTOGRAPHIC PRINTER

BACKGROUND OF THE INVENTION

1. Field of the Invention

The present invention relates to a refill cartridge for a wet electrophotographic printer, and more particularly, to a refill cartridge for a wet electrophotographic printer, having an improved internal structure.

2. Description of the Related Art

In general, a wet electrophotographic printer prints an intended image by developing a latent static image formed on a photosensitive medium, such as a photosensitive belt, with a developer liquid having a predetermined color. The printer then transfers the developed image onto paper.

In a conventional electrophotographic printer, in order to supply ink to a developing unit, a detachable ink cartridge is installed in a printer main body as a supply source. Thus, the location of the ink cartridge is limited to places that are easily accessible to a user. Accordingly, the path connecting the developing unit with the ink cartridge is long. Also, because functional parts such as a mixer, a dripless valve, an air hole and installation/detachment equipment are installed in the ink cartridge, replacing such an ink cartridge increases costs.

Considering such problems, the present applicant has suggested an ink supply apparatus for a wet electrophotographic printer in Korean Patent Application No. 98-6487. According to the ink supply apparatus there, an ink cartridge is fixed in a printer main body near a developing unit, and ink is provided to the fixed ink cartridge using a separate refill cartridge, without functional parts, thereby reducing costs.

However, the ink supply apparatus adopting the refill cartridge may increase warmup time because it takes time for the ink to be injected into the ink cartridge from the refill cartridge.

SUMMARY OF THE INVENTION

To solve the above problems, it is an objective of the present invention to provide a refill cartridge for a wet electrophotographic printer, whose structure is improved to enable an ink containing refill cartridge to rapidly supply an ink cartridge.

To achieve this objective, there is provided a refill cartridge for a wet electrophotographic printer, for supplying ink to an ink cartridge fixed in a printer main body having a hollow area therein, comprising: a case having an air hole and an ink supply hole, for detachable installation in the hollow area; a disk slidably mounted within the case; a spring for elastically biasing the disk toward the ink supply hole; and an ink supply hole plug capable of opening and closing the ink supply hole.

Preferably, the refill cartridge further includes a sealing member contacting the outer circumference of the disk and the inner circumference of the case.

Preferably, the ink supply hole plug comprises a coupling part coupled along the outside of the ink supply hole, and a puncturable seal part attached to the coupling part. The puncturable seal part is capable of opening the ink supply hole at the same time that the case is fitted into the hollow area.

Preferably, the refill cartridge further comprises an air hole plug capable of opening and closing the air hole.

Preferably, the refill cartridge further comprises a disk rod having one end coupled with the disk and the other end installed through the air hole, for reversely biasing the disk to secure room required for refilling ink within the case.

BRIEF DESCRIPTION OF THE DRAWINGS

The above and other objects and advantages of the present invention will become more apparent by describing in detail preferred embodiments thereof with reference to the attached drawings in which.

DESCRIPTION OF THE PREFERRED EMBODIMENTS

Figure 1:
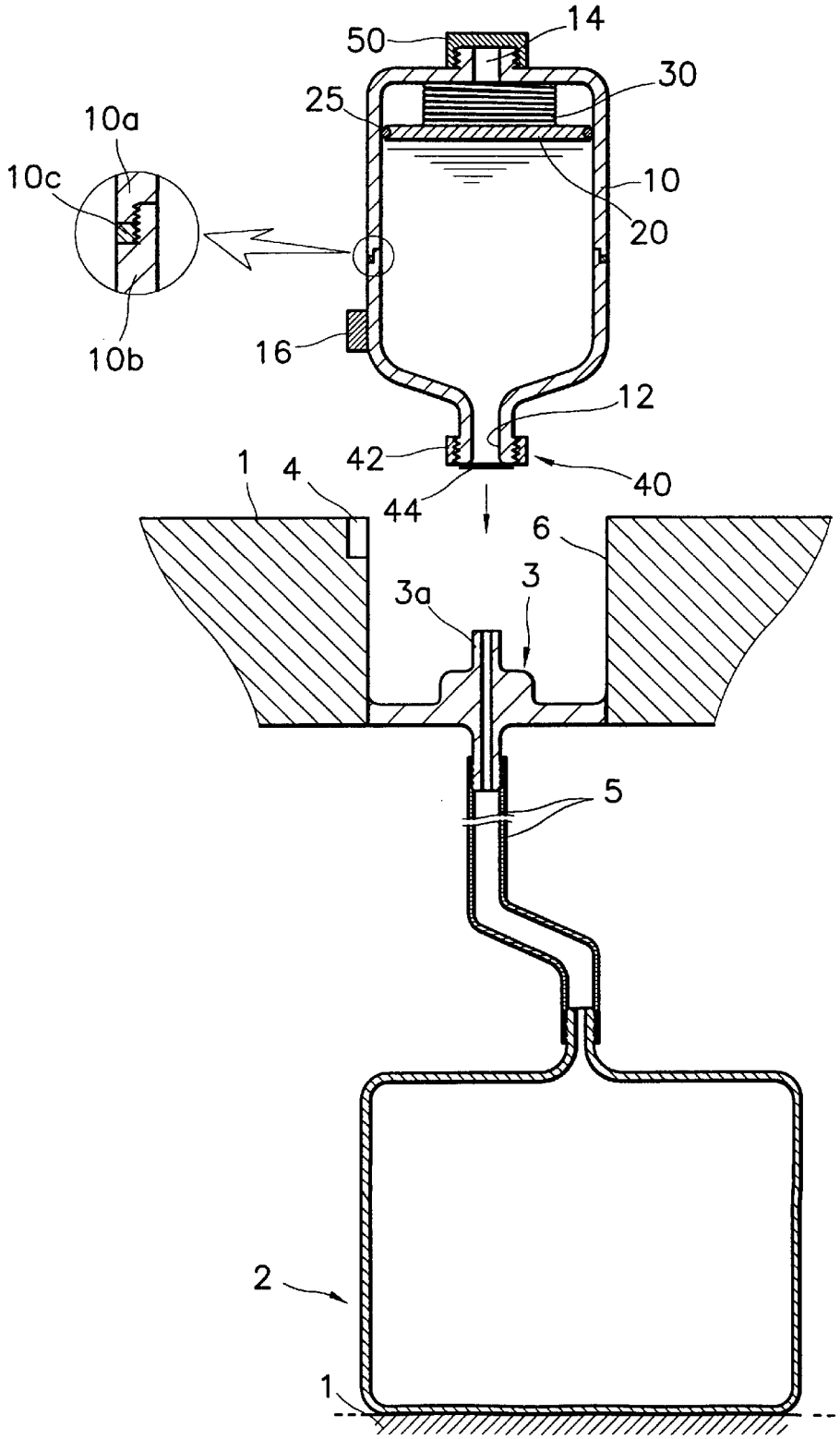
FIG. 1 shows the state of a refill cartridge according to a preferred embodiment of the present invention before it is installed in a printer main body.

As shown in FIG. 1, a refill cartridge for a wet electrophotographic printer according to a preferred embodiment of the present invention includes a case 10 for supplying ink to an ink cartridge 2 placed in a printer main body 1 via an ink supply hole 12. A disk 20 is installed in the case 10, and a sealing member 25 surrounds the outer circumference of the disk 20. A spring 30 elastically biases the disk 20 toward the ink supply hole 12. The refill cartridge also includes an ink supply hole plug 40.

A hollow area 6, having a valve 3 and a key hole 4 is formed in the printer main body 1. The valve 3 is connected to the ink cartridge 2 via a path 5.

The case 10 has an air hole 14 at the top thereof to smoothly supply ink contained therein through the ink supply hole 12. A color key 16 is disposed at the outer surface of the case. The color key 16 functions such that the color ink comparable to the color key 16 is provided to the corresponding ink cartridge when a color printer uses the refill cartridge. That is, the color key 16 is placed at an appropriate position of the case 10 by color. The color key 16 is inserted into the key hole 4 when the case 10 is fitted into the hollow area 6, so the color of ink contained in the case 10 is automatically recognized.

Figure 2:
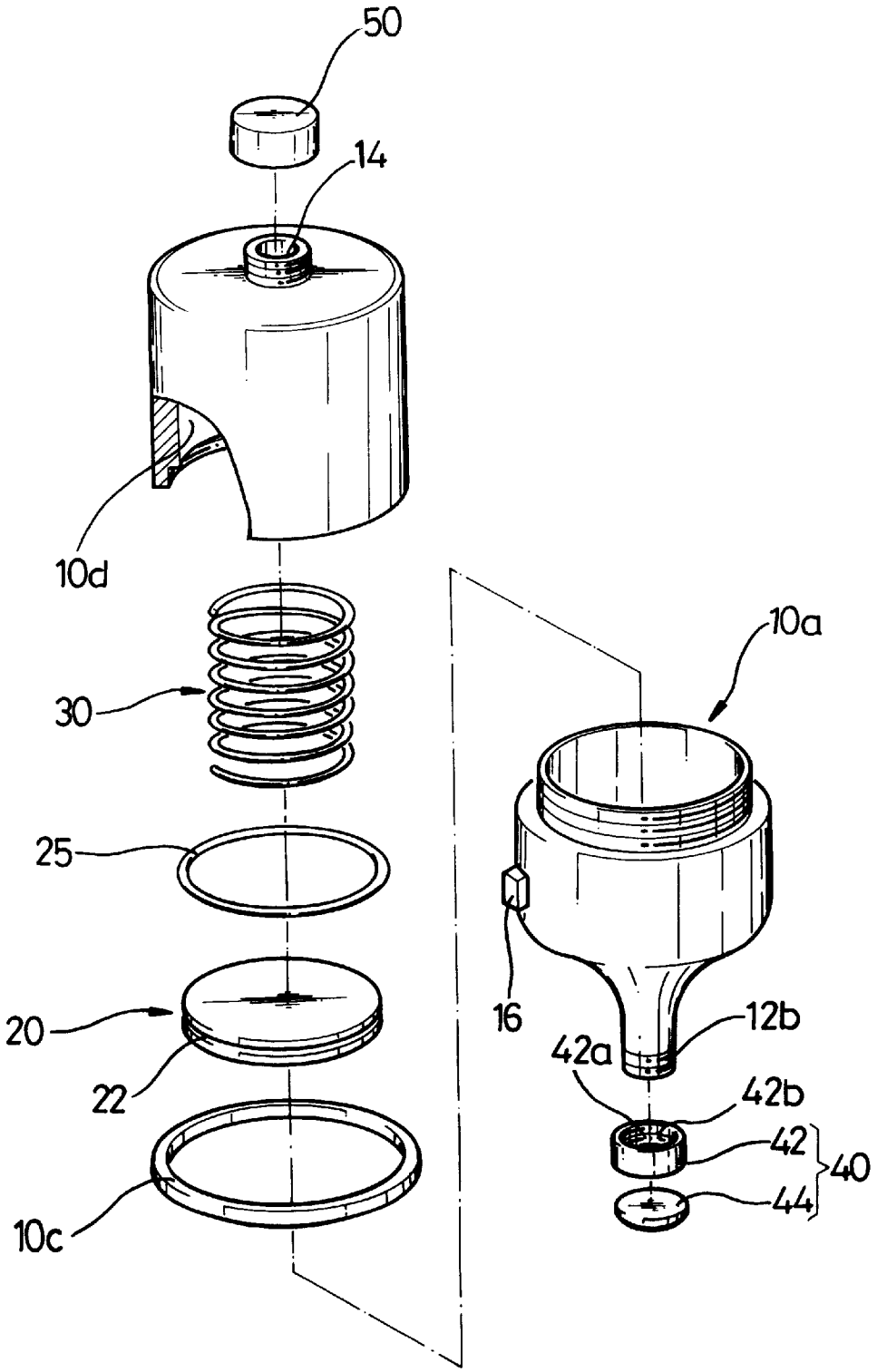
FIG. 2 is an exploded perspective view of the refill cartridge shown in FIG. 1 according to the present invention.

As shown in FIG. 2, the disk 20 is slidably mounted within the case 10. The disk 20 provides the ink cartridge 2 with ink contained in the case 10 when the ink supply hole 12 is coupled with the valve 3.

The sealing member 25 is inserted into a groove 22 of the disk 20. Thus, when the disk 20 slides to supply ink, discharging of ink to the air hole 14 is prevented.

The spring 30 is interposed between the air hole 14 and the disk 20 to elastically bias the disk 20 toward the ink supply hole 12 such that the disk 20 discharges ink contained in the case 10 through the ink supply hole 12.

Also, the case 10 is formed by combining an upper case 10*a* and a lower case 10*b*, with a washer (O-ring) 10*c* interposed between the upper and lower cases 10*a* and 10*b*. That is, after installing the disk 20 having the sealing member 25 and the spring 30 in the case 10, the upper and lower cases 10*a* and 10*b* are combined with the washer (O-ring) 10*c* interposed therebetween.

The ink supply hole plug 40 includes a coupling part 42 and a puncturable seal part 44 to plug the ink supply hole 12. Thus, it is easy for a user to handle the refill cartridge sealed with the ink supply hole plug 40. The ink supply hole 12 is then opened simultaneously when the sealed refill cartridge is lodged in the printer main body 1.

The coupling part 42 has a through hole 42*a* through which ink flows, and a screw thread 42*b* along the inner circumference thereof to be coupled with a screw thread 12*b* along the outer circumference of the ink supply hole 12. The puncturable seal part 44 is attached to the coupling part 42 to seal the through hole 42*a,* and opens the ink supply hole 12 by being torn at the same time with the insertion of the valve 3 when the case 10 is deposited in the printer main body 1. The puncturable seal part 44 may be constituted by a thin plastic film, soft rubber or perforated film. The seal part 44 may be directly attached to the coupling part 42 using adhesives, or by being formed integrally therewith. Alternatively, the puncturable seal part 44 may be used to cover ink supply hole 12 without also using coupling part 42. When the puncturable seal part 44 is used without coupling part 42, it may be directly coupled to the case 10 by, for example, an adhesive.

Also, an air hole plug 50 is used to selectively open and close the air hole 14. That is, the air hole 14 is closed by the air hole plug 50 before the refill cartridge is lodged in the printer main body. By removing air hole plug 50, thereby opening an air hole 14, air is allowed to flow into the case 10 after the refill cartridge is positioned in hollow area 6.

Figure 3:
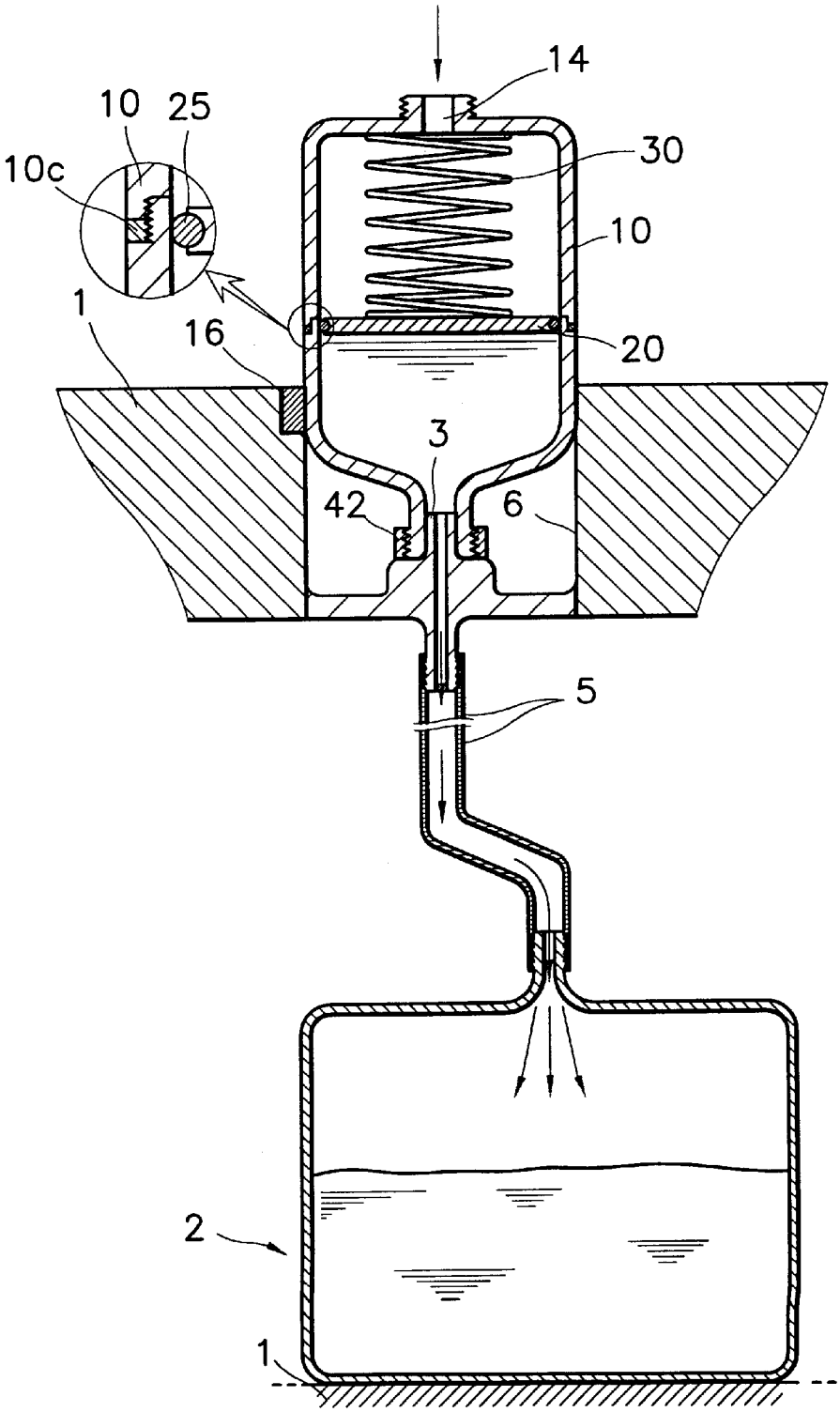
FIG. 3 is a diagram showing the supply of ink from the refill cartridge of FIG. 2 after being installed in a printer main body.

The process of supplying ink contained in the refill cartridge to the ink cartridge according to the embodiment of the present invention will be described with reference to FIG. 3.

First, when the refill cartridge is filled with ink and is positioned in the hollow area 6, the color key 16 inserts into the key hole 4. Simultaneously, a protrusion portion 3*a* of the valve 3 is pierced through the ink supply hole 12. Accordingly, the protrusion portion 3*a* runs through the puncturable seal part 44, (see FIG. 2) made of a thin film, and is inserted into the ink supply hole 12, so the ink supply hole 12 and the valve 3 are connected to each other. Then, by unplugging the air hole plug 50 from the air hole 14, ink contained in the case 10 flows into the ink cartridge 2 along the valve 3 and the path 5. The spring 30 pushes the disk 20 toward the ink supply hole 12. Thus, ink contained in the case is rapidly provided to the ink cartridge 2.

Figure 4:
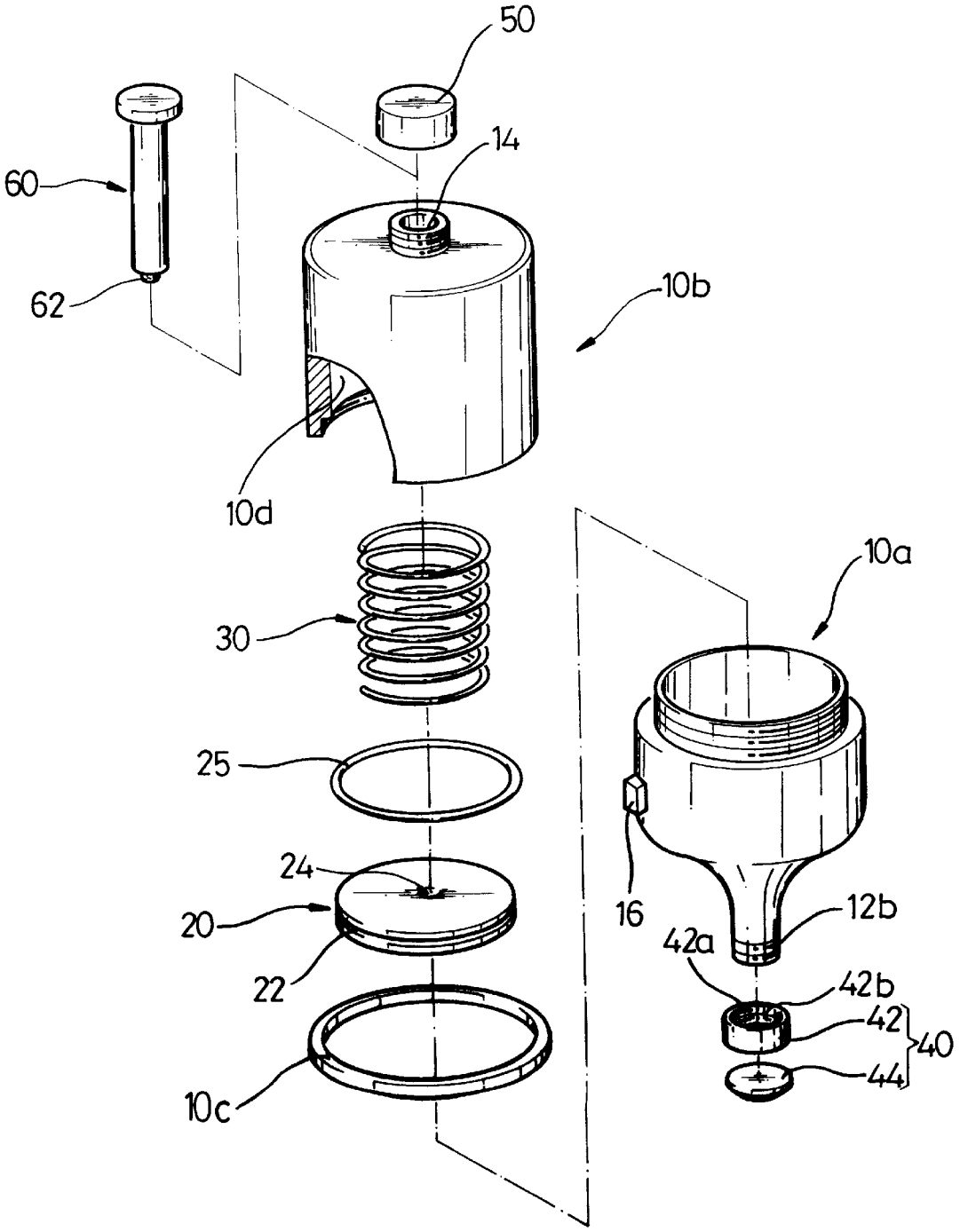
FIG. 4 is an exploded perspective view of a refill cartridge for a wet electrophotographic printer according to another embodiment of the present invention.

The structure of a refill cartridge according to another embodiment of the present invention is shown in FIG. 4. Here, the same reference numerals as those of FIG. 1 represent similar members having similar functions.

In this embodiment, the refill cartridge further comprises a disk rod 60. One end of the disk rod 60 is connected to the disk 20, and the other end thereof is installed through the air hole 14. This arrangement facilitates refilling an empty case 10 with ink by allowing the disk 20 to be reversely biased.

In the refill cartridge of the first embodiment, refilling the empty case with ink requires enough pressure to compress the spring 30. Thus, reusing the empty cartridge may be difficult. The disk 20 of this embodiment, however, has a screw hole 24, and the disk rod 60 has a protrusion capable of coupling with the screw hole 24. The disk rod 60 can then be used to bias the disk 20 in a direction which is the reverse of the bias imparted by spring 30.

The process of refilling the exhausted refill cartridge of this embodiment with ink will be described with reference to FIGS. 5 through 9.

Figure 5:
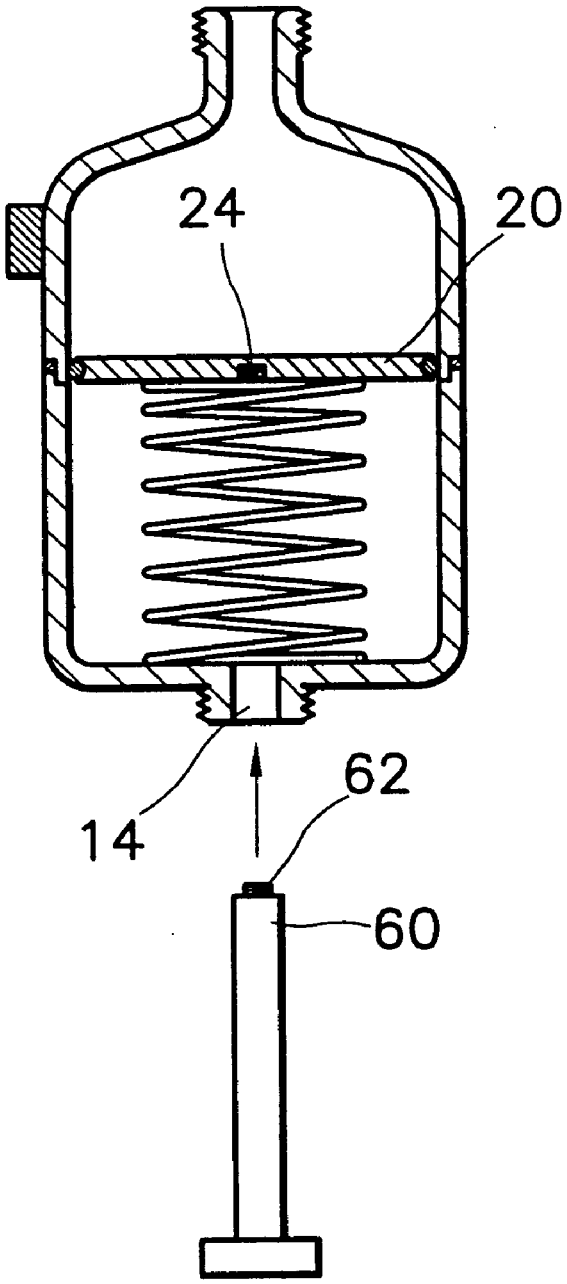
FIGS. 5 through 9 are diagrams illustrating the refilling of ink into the refill cartridge shown in FIG. 4.
Figure 6:
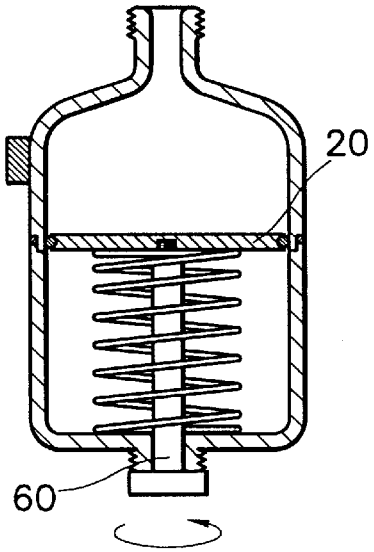
Figure 7:
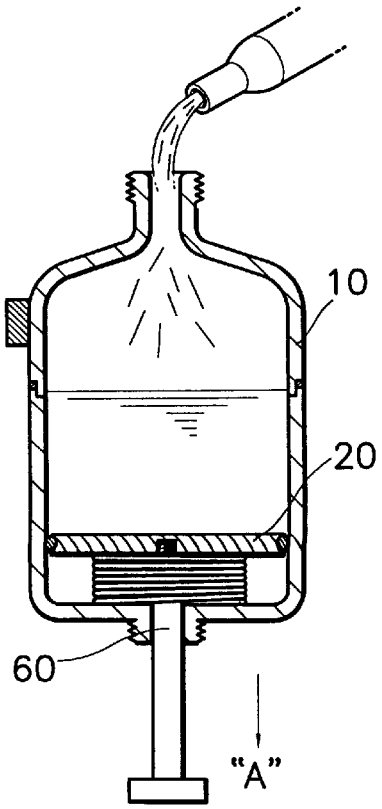
Figure 8:
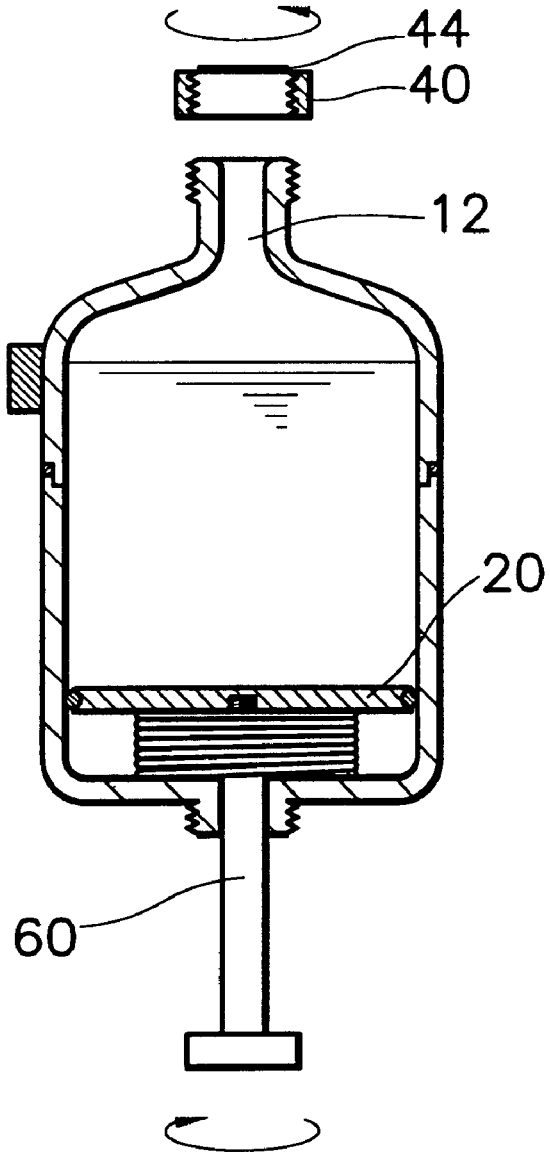
Figure 9:
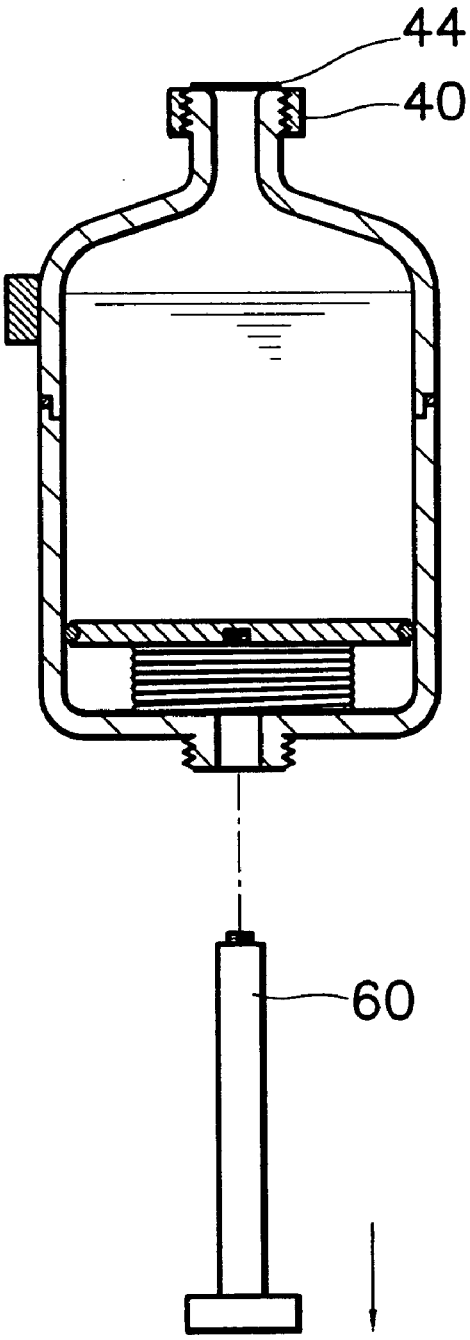

First, as shown in FIG. 5, after turning the empty cartridge upside down, the disk rod 60 is inserted into the air hole 14. Then, the protrusion 62 of the disk rod 60 is screwed into the screw hole 24 (see FIG. 6). As shown in FIG. 7, the disk rod 60 is then pulled in the direction "A" such that the disk 20 is placed as near the bottom of the case 10 as possible. Ink is refilled while the disk 20 is fixed to its position near the bottom of the case 10. Then, as shown in FIG. 8, after plugging the ink supply hole 12 with a new ink supply hole plug 40, the disk rod 60 is separated from the disk 20, thereby completing the refilling of the refill cartridge with ink as shown in FIG. 9.

As described above, according to the present invention, ink contained in the refill cartridge can be rapidly provided to the ink cartridge fixed in the printer main body, and it is easy for a user to refill an empty cartridge with ink. It is contemplated that numerous modifications may be made to the refill cartridge of the present invention without departing from the spirit and scope of the invention as defined in the following claims.

What is claimed is:

1. A refill cartridge for a wet electrophotogphic printer, for supplying ink to an ink cartridge fixed in a printer main body having a hollow area therein, comprising:

a case having an air hole and an ink supply hole, for detachable installation in the hollow area, said case having an inner circumference;

a disk, having an outer circumference, slidably mounted within the case;

a sealing member contacting the outer circumference of the disk and the inner circumference of the case;

a spring for elastically biasing the disk toward the ink supply hole; and an ink supply hole plug capable of opening and closing the ink supply hole.

2. The refill cartridge of claim 1, further comprising a disk rod having one end coupled with the disk and the other end installed through the air hole, for reversely biasing the disk to secure room required for refilling ink within the case.

3. The refill cartridge of claim 2, wherein said disk rod includes a protrusion having screw threads thereon, and said disk includes a screw hole having complementary screw threads which mate with those on said protrusion.

4. The refill cartridge of claim 1, wherein the ink supply hole plug comprises:

a coupling part coupled along the outside of the ink supply hole; and a puncturable seal part attached to the coupling part, capable of opening the ink supply hole at the same time that the case is fitted into the hollow area.

5. The refill cartridge of claim 4, further comprising an air hole plug capable of opening and closing the air hole.

6. The refill cartridge of claim 4, wherein said puncturable seal part is adhesively bonded to said coupling part.

7. The refill cartridge of claim 4, wherein said puncturable seal part is monolithic with said coupling part.

8. The refill cartridge of claim 1, further comprising a key on said case.

9. A refill cartridge for a wet electrophotographic printer, for supplying ink to an ink cartridge fixed in a printer main body having a hollow area therein, comprising:

a case having an air hole and an ink supply hole, for detachable installation in the hollow area, wherein said case is comprised of an upper case and a lower case which are detachable from one another, said case further having an inner circumference;

a disk, having an outer circumference, slidably mounted within the case;

a spring for elastically biasing the disk toward the ink supply hole; and an ink supply hole plug capable of opening and closing the ink supply hole.

10. The refill cartridge of claim 9, further comprising a seal between said upper case and said lower case.

11. The refill cartridge of claim 9, further comprising a key on said case.

* * * * *